United States Patent [19]

Suter

[11] 3,992,820

[45] Nov. 23, 1976

[54] GRINDING MACHINE INCLUDING MEANS TO SUPPLY COOLANT TO THE WORK AREA

[75] Inventor: Rolf Suter, Safenwil, Switzerland

[73] Assignee: Schenker Maschinen AG, Schonenwerd, Switzerland

[22] Filed: Jan. 28, 1976

[21] Appl. No.: 653,031

[30] Foreign Application Priority Data

Feb. 25, 1975 Switzerland ..... 2365/75

[52] U.S. Cl. ..... 51/118; 51/266

[51] Int. Cl.[2] ..... B24B 7/16; B24B 55/02

[58] Field of Search ..... 51/118, 111 R, 89, 356, 51/266, 267

[56] References Cited

UNITED STATES PATENTS

| | | | |
|---|---|---|---|
| 602,365 | 4/1898 | Schulze | 51/266 X |
| 2,753,667 | 7/1956 | Whitelaw | 51/118 |
| 2,869,294 | 1/1959 | Boettcher | 51/266 |
| 3,844,069 | 10/1974 | Shank | 51/118 |

OTHER PUBLICATIONS

"Cooled Fixture Table", I.B.M. Technical Disclosure Bulletin, vol. 13, No. 9, Feb. 1971.

*Primary Examiner*—James L. Jones, Jr.
*Assistant Examiner*—Nicholas P. Godici
*Attorney, Agent, or Firm*—Michael J. Striker

[57] ABSTRACT

A machine for grinding objects, especially helical-or coil-type springs whose opposite ends are to be ground, includes a pair of rotary grinding discs having grinding surfaces spaced in axial direction from each other so as to define a work station. A plate-shaped element having a region mounted for turning movement relative to the work station intermediate the grinding surfaces is formed with a plurality of apertures, each of which is adapted to receive an object which is to be ground by contact with the grinding surfaces. Channels are provided in the plate-shaped element and connect the apertures with a source of fluid for supplying the latter to the apertures.

10 Claims, 3 Drawing Figures

GRINDING MACHINE INCLUDING MEANS TO SUPPLY COOLANT TO THE WORK AREA

BACKGROUND OF THE INVENTION

The present invention relates to a machine for grinding objects and, more particularly, to a machine which grinds helical- or coil-type springs.

It is known in the prior art to grind springs using grinding discs which contact the axial end faces of the springs. However, such prior-art techniques share the common disadvantage that they are conducted under dry conditions. Excessive heat rapidly builds up which, in turn, causes quick wear and tear on the grinding surfaces of the discs.

The prior art has not solved these drawbacks because it has proven difficult to conduct sufficient quantities of a cooling medium towards the working station defined intermediate the grinding surfaces of the discs where the grinding takes place.

SUMMARY OF THE INVENTION

Accordingly, it is the general object of the present invention to overcome the disadvantages of the prior art.

Another object of the present invention is to increase the working efficiency of a grinding machine.

An additional object of the present invention is to decrease the wear and tear of grinding surfaces of grinding discs employed in grinding machines.

Yet a further feature of the present invention is to substantially reduce the build-up of excessive heat during grinding.

A further object of the present invention is to adequately cool the work station where the grinding takes place.

In keeping with these objects and others which will become apparent hereinafter, one feature of the invention resides in a combination in a machine for grinding objects, particularly helical springs, which comprises a pair of rotary grinding discs having grinding surfaces spaced in axial direction from each other and defining a work station. The machine further comprises an element having a region mounted for turning movement relative to the work station intermediate the grinding surfaces, said region having a plurality of apertures each adapted to receive an object whose opposite ends are to be ground by contact with the grinding surfaces. Furthermore, passage means including channels are provided in the element and permit the apertures to communicate with a source of fluid for supplying the latter to the apertures.

The feature of providing channels in the element permits a fluid such as a cooling medium to cool the apertures during the grinding operation. Of course, the cooling medium serves not only to cool the apertures but also the workpieces contained in the apertures. In addition, the fluid eventually is discharged from the apertures so that it may flow between the opposite sides of the element and the grinding surfaces of the discs in order to cool the entire working station. As an additional benefit, if the fluid used is a liquid, the liquid will facilitate the removal of the workpieces out of the apertures after grinding has been completed.

In this manner, the working efficiency of the grinding machine is greatly increased. Indeed, not only is the wear and tear of the grinding surfaces of the discs decreased but also the build-up of excessive heat during grinding is substantially reduced.

In accordance with yet another feature of the present invention the element is journalled by a bearing member which has a projecting rib formed with an arcuate slot. The arcuate slot has an open end which is alternately registered with openings provided at an end of the channels opposite to the end which is connected to the apertures as the element is turned past the slot. Thus, whenever the workpieces contained in the apertures of the element are being ground in the work station, communication is permitted between the source of fluid and the apertures. Whenever these apertures are moved out of the work station and the work pieces are no longer being ground, the flow of fluid is interrupted towards these apertures and, instead, the next successively-registered apertures located in the work station receive the fluid.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
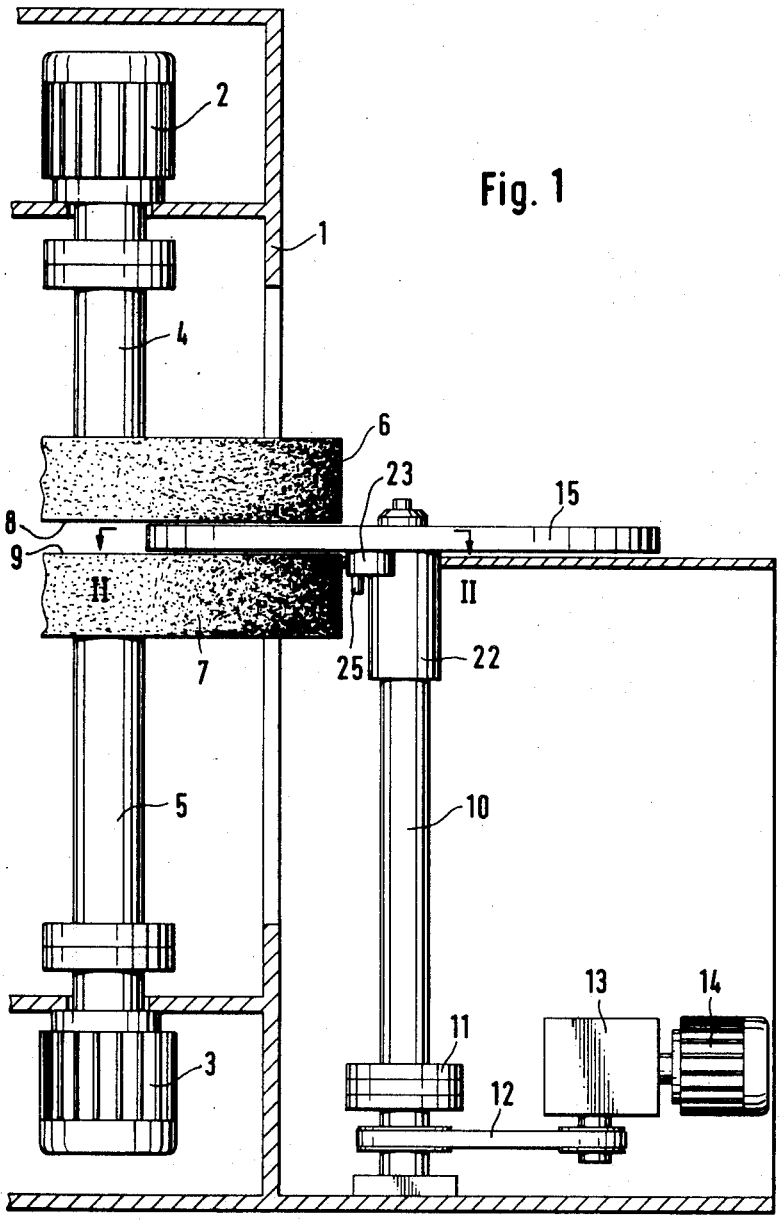
FIG. 1 is a broken-away side view, partially in section, of a grinding machine in accordance with the present invention.

FIG. 1 generally shows a grinding machine comprising a stationary frame or housing 1 which supports a pair of motors 2 and 3. The motors 2 and 3 are respectively connected with grinding wheels or discs 6 and 7 by means of coxially-arranged shafts 4 and 5. The discs 6 and 7 are spaced in axial direction from each other and are formed with grinding surfaces 8 and 9 which are preferably substantially parallel to each other and which define a work station therebetween.

The housing also supports an annular element or plate 15 which is mounted for turning movement relative to the work station. The plate 15 is fixedly mounted at an end of shaft 10 which extends in direction parallel to the shafts 4 and 5. The other end of the shaft 10 is connected to and driven by motor 14 by means of a variable drive device 13, a drive or V-belt 12, and a friction-type coupler 11.

Figure 2:
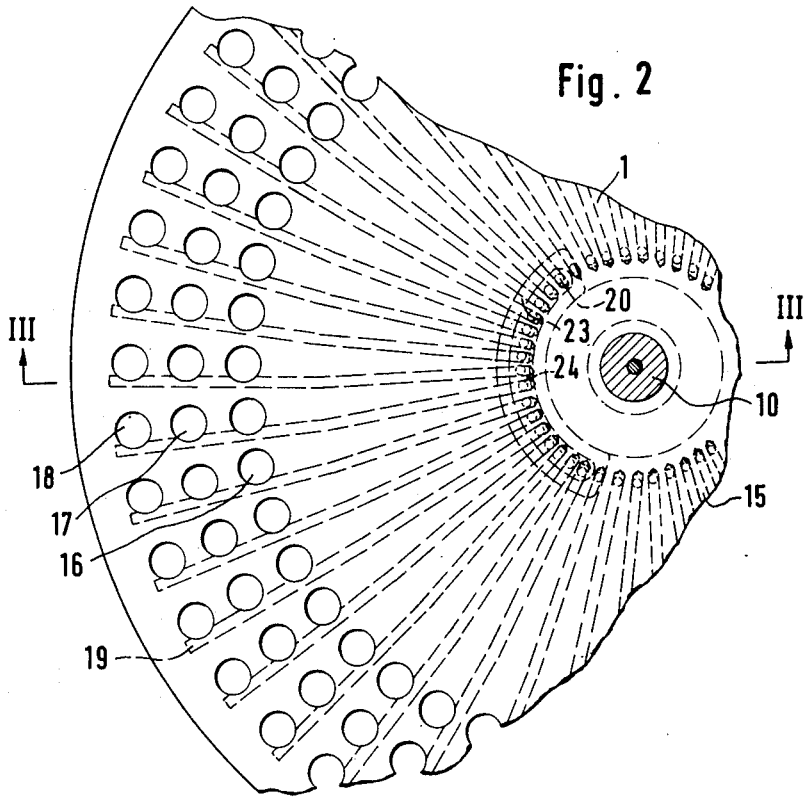
FIG. 2 is a partial view as seen in direction of the arrows of line II—II of FIG. 1.
Figure 3:
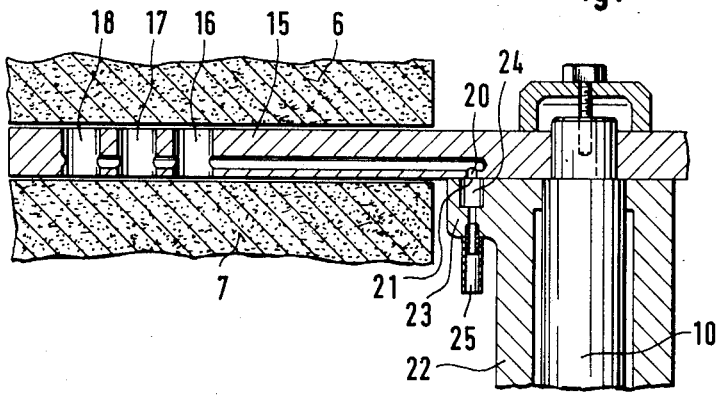
FIG. 3 is a partial view as seen in direction of the arrows of line III—III of FIG. 2.

A region of the plate 15 is located intermediate the grinding surfaces 8 and 9; and this region is provided with a plurality of apertures which are more clearly shown in FIG. 2. The apertures, which can be arranged in any manner, are shown preferably arranged in three, circular, concentrically-arranged groups 16, 17 and 18, each group being spaced in radial direction from each other. Each aperture extends from the upper side towards the lower side of the plate 15 and is adapted to axially receive and hold a workpiece or object whose opposite ends are to be ground by respective direct physical contacts with the grinding surfaces 8 and 9.

One specially preferred workpiece is a helical- or coil-type spring whose opposite ends are desired to be ground flush in planes substantially normal to the elongation of the spring.

Passage means including channels 19 are formed in the plate 15 and each extend generally linearly in radial direction from the center towards the outer periphery of the plate 15. Each channel 19 communicates with at least one of the apertures of each of the groups 16, 17 and 18. As shown in FIG. 2, the apertures of groups 16, 17, 18 are radially spaced and aligned relative to each other so as to form a pluraity of linear sets which extend radially along the plate 15 in the direction of the elongation of the channels 19.

At the ends of the channels 19 which are opposite to the ends which communicate with the apertures, that is at the inner central region of plate 15, a plurality of transverse bores 20 are provided in the plate 15, each of which extend generally parallel to the elongation of the shaft 10. The bores 20 reach the underside of the plate 15 and have mouths or openings 21 which are circumferentially arranged about the plate 15 in a circular configuration with respect to the elongation of the shaft 10.

The shaft 10 is circumferentially journalled by bearing member 22 which has a rib-like projection 23 which extends partially in circumferential direction about the shaft 10. The projection 23 is formed with an arcuate channel or slot 24 which has an open end facing the underside of the plate 15 and overlying the bore openings 21. The opposite end of the slot 24 communicates with the interior of a conduit 25 which is adapted to be connected with a non-illustrated source of fluid. The underside of the plate 15 is tightly and sealingly flush-mounted against the projection 23.

In the operation of the grinding machine, the workpieces are placed in selected ones of the apertures 16, 17 and 18 so that the opposite ends of the workpieces project slightly out of the opposite sides of the plate 15. The motors 2 and 3 respectively rotate the discs 6 and 7.

In order to improve the grinding efficiency, the fluid, which is conducted under pressure from a source that is connected to the conduit 25 and which is consecutively passed through the slot 24, the bore 20, and the channels 19 towards the apertures 16, 17 and 18, is preferably a cooling fluid such as any gaseous medium, liquid medium or combinations thereof.

As the plate 15 is turned continuously by the motor 14 relative to the bearing member 22, the opposite ends of the workpieces projecting out of the apertures 16, 17 and 18 intermediate the grinding surfaces 8 and 9 are ground. At this time, the openings 20 of the channels 19 which communicate with the apertures 16, 17 and 18 currently situated intermediate the grinding surfaces 8 and 9 register with the slot 24 and permit the cooling fluid to flow towards the apertures. As these apertures are moved out of the work station, the flow towards these apertures is interrupted because the corresponding openings 20 no longer register with the slot 24 due to the continuous movement of the plate 15 relative to the slot 24. Instead, the next successively-registered apertures receive the fluid.

The fluid serves not only to cool the apertures 16, 17 and 18, but also the workpieces themselves contained in the apertures are cooled. Moreover, the fluid eventually exits out of the apertures and flows between the opposite sides of the plate 15 and the grinding surfaces 8 and 9 in order to also cool the latter and the entire work station. Furthermore, if the fluid is a liquid, it facilitates the removal of the workpieces out of the apertures.

It will be understood that the present invention is not intended to be limited to the particular geometric patterns of the apertures or bore openings described above since other patterns may be employed. In addition, each of the channels 19 need not be elongated solely in linearly radial direction.

It will be understood that each of the elements described above, or two or more together, may also find a useful application in other types of constructions differing from the types described above.

While the invention has been illustrated and described as embodied in a grinding machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

I claim:

1. In a machine for grinding objects, particularly springs, a combination comprising a pair of rotary grinding discs having grinding surfaces spaced in axial direction from each other and defining a work station; an element having a region mounted for turning movement relative to said work station intermediate said grinding surfaces, said region having a plurality of apertures each adapted to receive an object whose opposite ends are to be ground by contact with said grinding surfaces; and passage means including channels provided in said element and communicating said apertures with a source of fluid for supplying said fluid to said apertures.

2. A combination as defined in claim 1, wherein said channels are cooling channels, and wherein said fluid is a cooling liquid.

3. A combination as defined in claim 1, wherein said grinding surfaces are substantially parallel to each other.

4. A combination as defined in claim 1, wherein said element has a plate-shaped configuration formed with an upper planar side and a lower planar side which are substantially parallel to said grinding surfaces, and wherein said apertures extend from said upper side to said lower side of said element.

5. A combination as defined in claim 1, wherein said element is annular, and wherein said plurality of apertures are circumferentially-arranged about said element in circular, concentric groups.

6. A combination as defined in claim 5, wherein said apertures of said groups are radially spaced and aligned relative to each other so as to form a plurality of linear sets of apertures which extend radially of said element.

7. A combination as defined in claim 6, wherein said channels extend linearly in radial direction of said element, each channel respectively communicating with each of the apertures which comprise said linear sets of apertures.

8. A combination as defined in claim 1, wherein all of said channels have ends which communicate with said apertures and other ends which extend to a side of said element, said other ends having openings which are circumferentially arranged about said element in a circular configuration.

9. A combination as defined in claim 1, wherein said element is fixedly mounted on a shaft; and further comprising a bearing member circumferentially journalling said shaft.

10. A combination as defined in claim 9, wherein said bearing member has an arcuate slot extending partially in circumferential direction about said shaft, said slot having an open end facing said element which registers with the openings of said channels which move past said slot when said element turns through said work station so as to permit communication between the apertures located between said grinding surfaces and a source of fluid and which, in response to further movement of said element out of said work station, interrupts the flow of the fluid towards said channels.

* * * * *